US005992330A

United States Patent [19]

Gilbert et al.

[11] Patent Number: 5,992,330

[45] Date of Patent: Nov. 30, 1999

[54] RAILWAY VEHICLE SUSPENSION ALIGNED TRUCK

[75] Inventors: Kim T. Gilbert, Lancaster; Richard B. Polley, Gahanna; Todd A. Porter, Columbus, all of Ohio

[73] Assignee: Buckeye Steel Castings Co., Columbus, Ohio

[21] Appl. No.: 08/858,672

[22] Filed: May 19, 1997

[51] Int. Cl.[6] ..... B61F 5/50

[52] U.S. Cl. ..... 105/200

[58] Field of Search ..... 105/167, 168, 105/193, 200, 201, 207

[56] References Cited

U.S. PATENT DOCUMENTS

| | | | |
|---|---|---|---|
| 2,219,360 | 10/1940 | Green | 105/200 |
| 2,268,267 | 12/1941 | Sheesley | 105/200 |
| 3,650,220 | 3/1972 | Lich . | |
| 5,584,250 | 12/1996 | Berg | 105/182.1 |
| 5,588,367 | 12/1996 | Scheffel | 105/168 |
| 5,603,265 | 2/1997 | Jones | 105/167 |
| 5,609,109 | 3/1997 | Berg | 105/206.1 |
| 5,632,208 | 5/1997 | Weber | 105/182.1 |
| 5,647,283 | 7/1997 | McKisic | 105/167 |

FOREIGN PATENT DOCUMENTS

| | | | |
|---|---|---|---|
| 738202 | 7/1966 | Canada | 105/200 |

*Primary Examiner*—S. Joseph Morano
*Attorney, Agent, or Firm*—Banner & Witcoff, Ltd.

[57] ABSTRACT

A railway vehicle truck assembly comprises the following, in part: wheel sets having longitudinally spaced, transversely extending axles, and wheels mounted to the axles; transversely spaced longitudinally extending side frames mounted to the axles; and a transversely extending bolster mounted to the side frames. The bolster has a center bowl and opposed, elongated bolster arms extending from the center bowl. The bolster arms each form spaced structural walls, a first of the structural walls of the bolster arms having a bolster anchor fitting defined thereon, and a second of the structural walls having a bolster anchor opening defined therethrough. The structural walls further define an inner cavity between the walls, and bolster anchors connect the side frames to the bolster. The bolster anchors are located transversely between the side frames, further extend to the fittings, and extend at least in part through the inner cavity of the bolster and the bolster anchor openings to brackets on the side frames. Conventional equipment is useful for casting the components of the truck, the truck is quite economical, and the bolster anchors greatly enhance the alignment and performance of the trucks. The trucks are significantly smoother riding, better curving, suitable for higher train speeds, and provide railcars suitable for more sensitive payloads.

10 Claims, 5 Drawing Sheets

RAILWAY VEHICLE SUSPENSION ALIGNED TRUCK

BACKGROUND OF THE INVENTION

This invention relates to railway vehicles or railcars, and more particularly to railway vehicle suspensions.

Description of the Related Patents, Publications and the Like

Railway vehicles generally comprise bodies located atop trucks, also known as bogies. The trucks generally comprise wheels on axles, with side frames on the axles, and truck bolsters on the side frames. As often seen on railroads in the United States of America, the total number of wheels of a single truck is four, the number of side frames of a truck is two, the number of truck bolsters is one, and the number of trucks per body is two, one at each end of the railcar. The side frames of the trucks are aligned with the rails, and generally located over the rails. The bolsters are transverse to the side frames and rails. A center bowl is located atop and typically as part of each bolster, and a center plate fits in each center bowl. The center plate is fitted to the car body, and pivotal movement between the body and trucks happens between the center plates and center bowls. In freight service, the truck bolster is formed separately from the side frames, and vertical movement between the body and the track rails occurs between the truck bolsters and the truck side frames. Springs between the bolsters and side frames cushion the vertical movement.

Conventional freight railway vehicle trucks as described have compiled a long record of effective and reliable service as railcar (railway vehicle) suspensions. At the same time, the sizable forces and loads encountered in freight rail service cause dramatic wear and consequent problems with conventional trucks. A significant source of wear is misalignment of freight trucks. As railcars traverse curved tracks, the outer rails of curves are inherently longer than the inner rails of curves, and freight trucks tend to become misaligned, and truck components stressed, as the outer wheels (the wheels on the outer rails of curves) lag behind the inner wheels (the wheels on the inner rails of curves). Conventional freight trucks are kept aligned, or "in tram, " by column guides at the junctures of the bolsters and side frames, and by the journal bearings on the axles. As freight trucks age, these components wear, and the consistency of alignment of the truck components is much reduced. Trucks may remain misaligned after curves for substantial distances and times. Wheel axles, then, are misaligned, and the flanges of the wheels are subjected to increased wear. Column guides also wear further. Center bowls become misshapen under stress, tending to become elliptical. As the center bowls change shapes, more horizontal movement between components becomes possible. More wear occurs on relevant surfaces of substantially all components.

To address these problems, a Commonwealth Aligned truck produced by General Steel Industries, Inc. was put into service in the 1960s. This truck included anchors fastened between the side frames and truck bolster, outboard of the side frames, and further anchors inboard of the side frames and above the top plates of the bolsters. While the Commonwealth Aligned truck remains available theoretically, in practice this truck is unavailable. In part, automatic molding equipment is now utilized for the simultaneous casting of quantities of railcar truck components. The design of the Commonwealth Aligned truck is nonstandard, and inconsistent with the use of current automatic molding equipment.

Conventional freight railcar trucks which through wear allow significant motions of railcar bodies are generally acceptable in the United States, because mininizing equipment costs has been a primary consideration in freight railroading in the United States. High performance trucks may or may not be available, but conventional trucks are used. One consequence of these trucks is that products and payloads that would be damaged by the motions allowed by conventional trucks cannot be reliably shipped by rail. Sophisticated lading cushioning devices have been required. Further, train speeds have tended to be limited in an effort to limit railcar motion and consequent damage.

SUMMARY OF THE INVENTION

Objects of the present invention are to improve freight railcar trucks to provide railcars that are suitable for more sensitive payloads than in the past, that are smoother riding, that are better "curving, " meaning they handle track curves more readily, that are suitable for higher train speeds, and yet are highly economical and use existing production equipment.

These and other objects, advantages and features of the invention will become more apparent upon a reading of the detailed description of preferred embodiments of the invention, which follows, and reference to the drawing which accompanies this description. Nevertheless, in summary, and in one aspect, the invention takes the form of a railway vehicle truck assembly comprising the following, in part: wheel sets having longitudinally spaced, transversely extending axles, and wheels mounted to the axles; transversely spaced longitudinally extending side frames mounted to the axles; a transversely extending bolster mounted to the side frames; and uniquely positioned bolster anchors. The truck bolster has a center bowl and opposed, elongated bolster arms extending from the center bowl. The bolster arms each form spaced structural side walls, a first of the side walls of the bolster arms having a bolster anchor fitting defined thereon, and a second of the structural walls having a bolster anchor opening defined therethrough. The structural walls further define an inner cavity between the walls. The bolster anchors connect the side frames to the bolster. They are located transversely between the side frames, they are fastened to the fittings on the bolster arm side walls, and they extend from the fittings through the inner cavity of the bolster and the bolster anchor openings, and then to brackets mounted to the truck side frames.

With a truck, bolster and anchors as described, the objects of the invention are achieved. Conventional equipment is useful for casting the components of the truck, the truck is quite economical, and the bolster anchors greatly enhance the alignment and performance of the trucks. The trucks are significantly smoother riding, better curving, suitable for higher train speeds, and provide railcars suitable for more sensitive payloads. As an example, use of the trucks is anticipated in freight railcars incorporated into higher speed, more motion sensitive Amtrak® trains.

BRIEF DESCRIPTION OF THE DRAWING

The accompanying drawing includes a variety of figures. Like numbers refer to like parts throughout the drawing. In the drawing.

Figure 1:
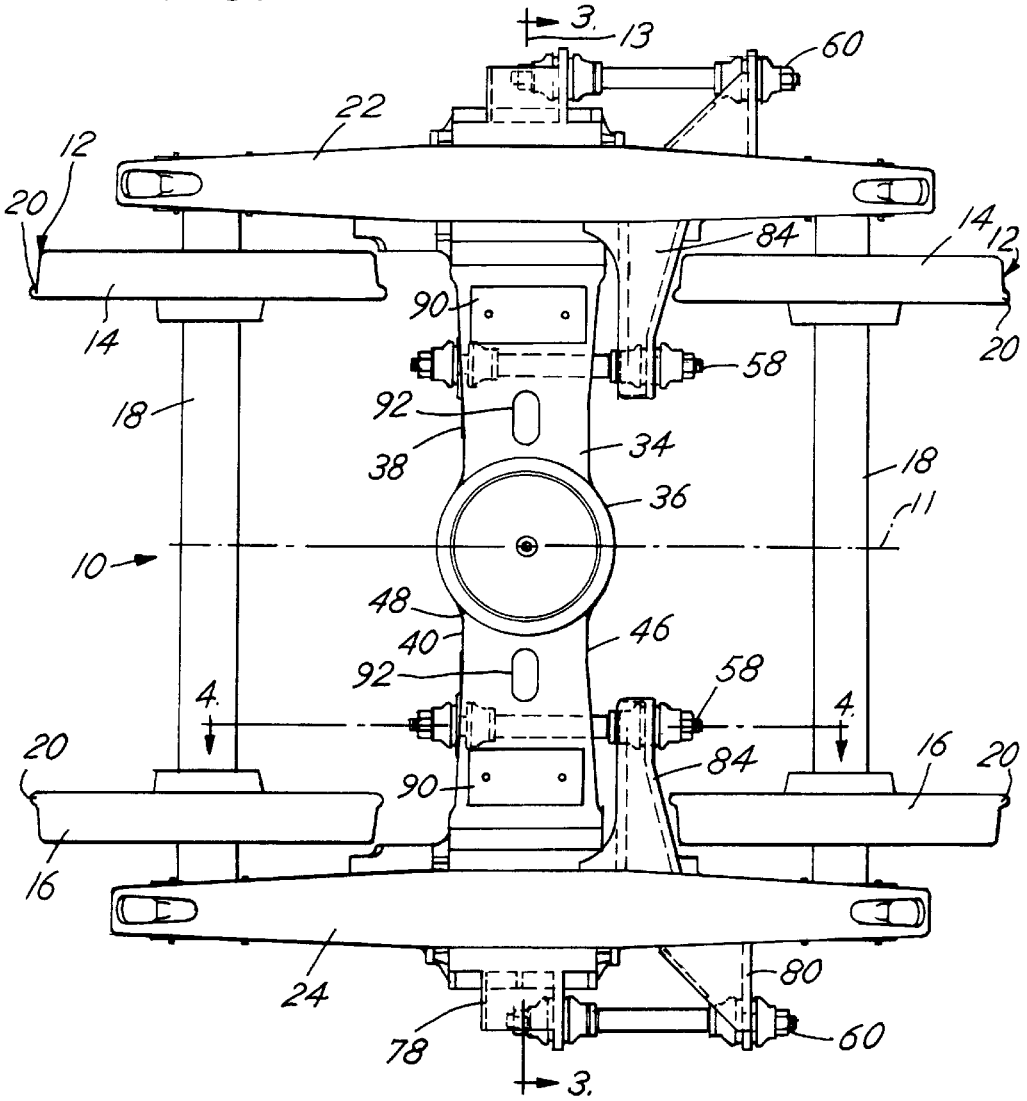
FIG. 1 is a plan view of a freight railcar truck according to the invention.

The following reference numbers are used in the drawing and Detailed Description of the Preferred Embodiment:

10 a preferred form of a freight railcar truck according to the invention
12 wheel sets
14 wheels
16 wheels
18 axles
20 wheel flanges
22 side frame
24 side frame
26 pedestal jaws
27 jaw centerlines
28 pedestal jaws
29 jaw centerlines
30 journal boxes
32 journal boxes
34 truck bolster
36 center bowl
38 bolster arm
40 bolster arm
42 bolster top plate
44 bolster bottom plate
46 bolster side wall
48 bolster side wall
50 side frame bolster arm openings
51 springs
52 spring seat bosses
54 spring seat bosses
56 column guides
58 inner bolster anchors
60 outer bolster anchors
62 tie rod
63 rubber pad gap
64 spacer
65 anchor cushioning subassembly
66 rubber pad
67 rubber pad hemisphere
68 innercup
69 rubber pad hemisphere
70 outer cup
71 tie rod channel
72 adjustment washers
74 slotted nuts
76 cotter pins
78 first outer bolster anchor bracket
80 second outer bolster anchor bracket
82 plates of the bolster anchor brackets
84 inner bolster anchor bracket
86 bolster anchor fittings or seats
88 bolster anchor openings
90 side bearing mounts
92 lightener openings

DESCRIPTION OF THE PREFERRED EMBODIMENT

Referring to FIG. 1, a preferred form of a freight railcar truck according to the invention, shown in plan view, i.e., from overhead, is generally designated 10. The truck is utilized as typical in tandem with another identical or substantially similar truck for supporting and transporting one or more freight railcars on railway rails. As more conventional, two trucks support one railcar. As less conventional, trucks may be shared by adjacent railcars.

For background and orientation, the typical rails extend at great length in parallel, in a direction defined as longitudinal. The rails are spaced from each other in a direction defined as transverse. In service, the truck 10 is mounted on the rails, as in FIG. 2. The longitudinal direction in relation to the truck, whether in service or otherwise, for purposes of this description, is along FIG. 1 centerline 11, and is the same direction as the longitudinal direction of rails under a truck in service. The transverse direction along transverse centerline 13 is similar.

A truck 10 includes wheel sets 12, comprising flanged railway wheels 14, 16, spaced transversely from each other, and joined by a transversely extending axle 18. As conventional, the depicted truck 10 includes two longitudinally spaced wheel sets 12. In service, the wheels 14, 16 follow the rails of the underlying rail line, and in part, maintain transverse relation to the rails through opposed, integral inner flanges 20. The wheels and axles are separately cast of steel and joined together.

Transversely spaced side frames 22, 24 are supported on the wheel sets 12. The side frames 22, 24 are longitudinally elongated, and referring to FIG. 2, where side frame 24 is shown by example, define longitudinally spaced, downwardly opening pedestal jaws 26, 28 along jaw centerlines 27, 29. Journal boxes 30, 32 are mounted in the jaws 26, 28, and the boxes rotatably receive the journal portions of the axles 18. The wheels sets 12 and side frames 22, 24 are mounted together by the journal boxes 30, 32. Thus, the jaw centerlines 27, 29 are also generally centerlines of the wheels 14, 16 and axles 18.

Figure 2:
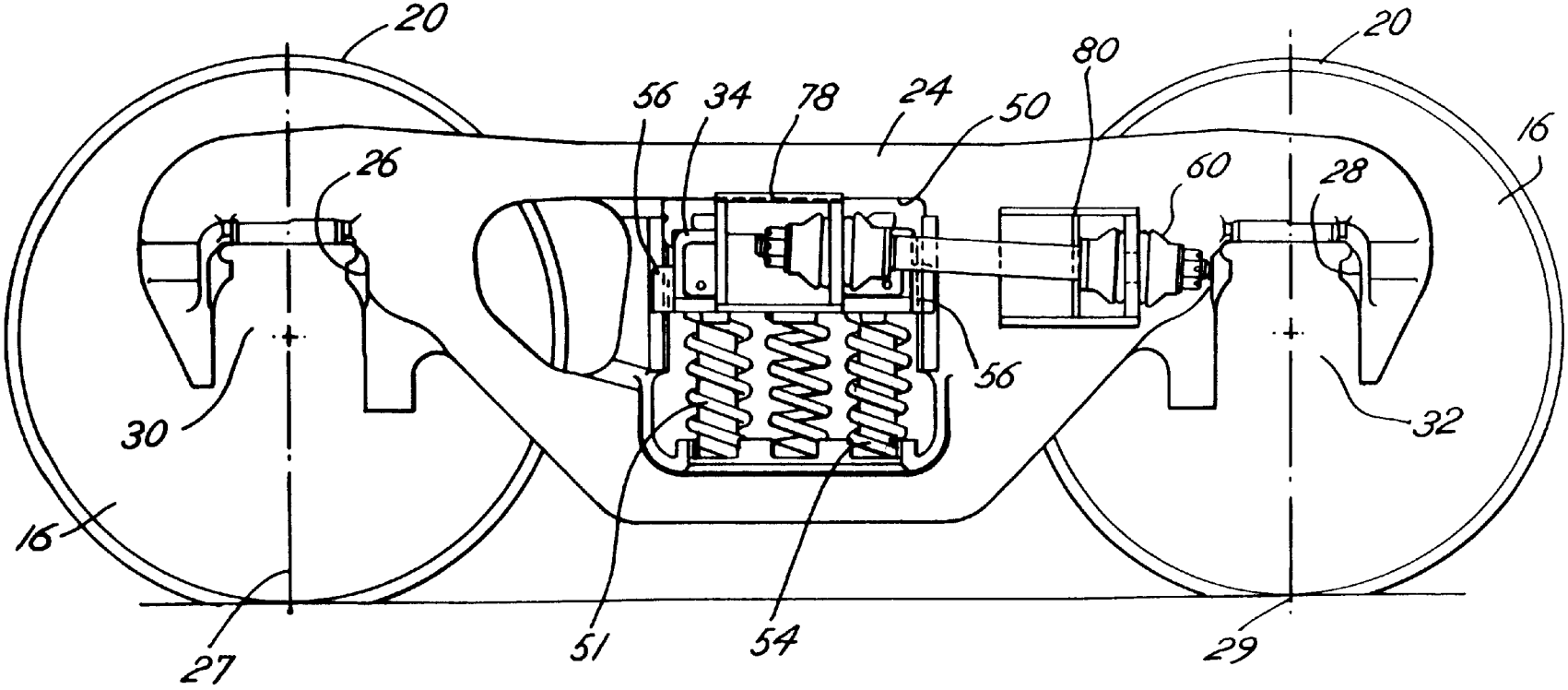
FIG. 2 is a side elevation view of the truck of FIG. 1.
Figure 3:
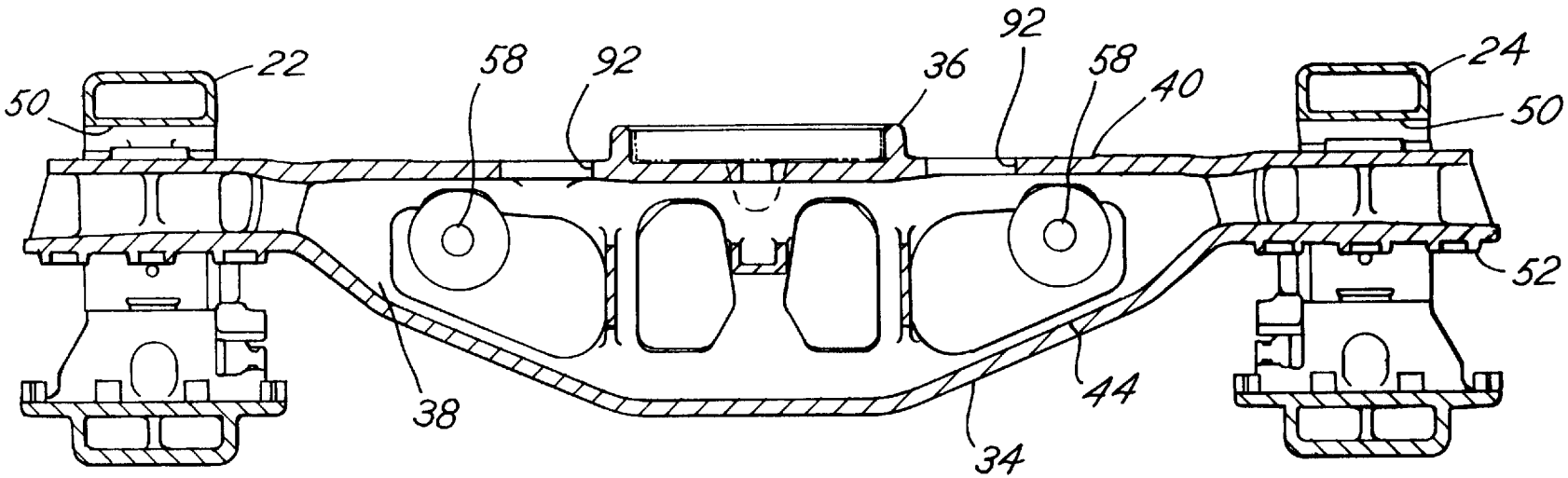
FIG. 3 is a first cross-section of the truck through the transverse centerline thereof.
Figure 4:
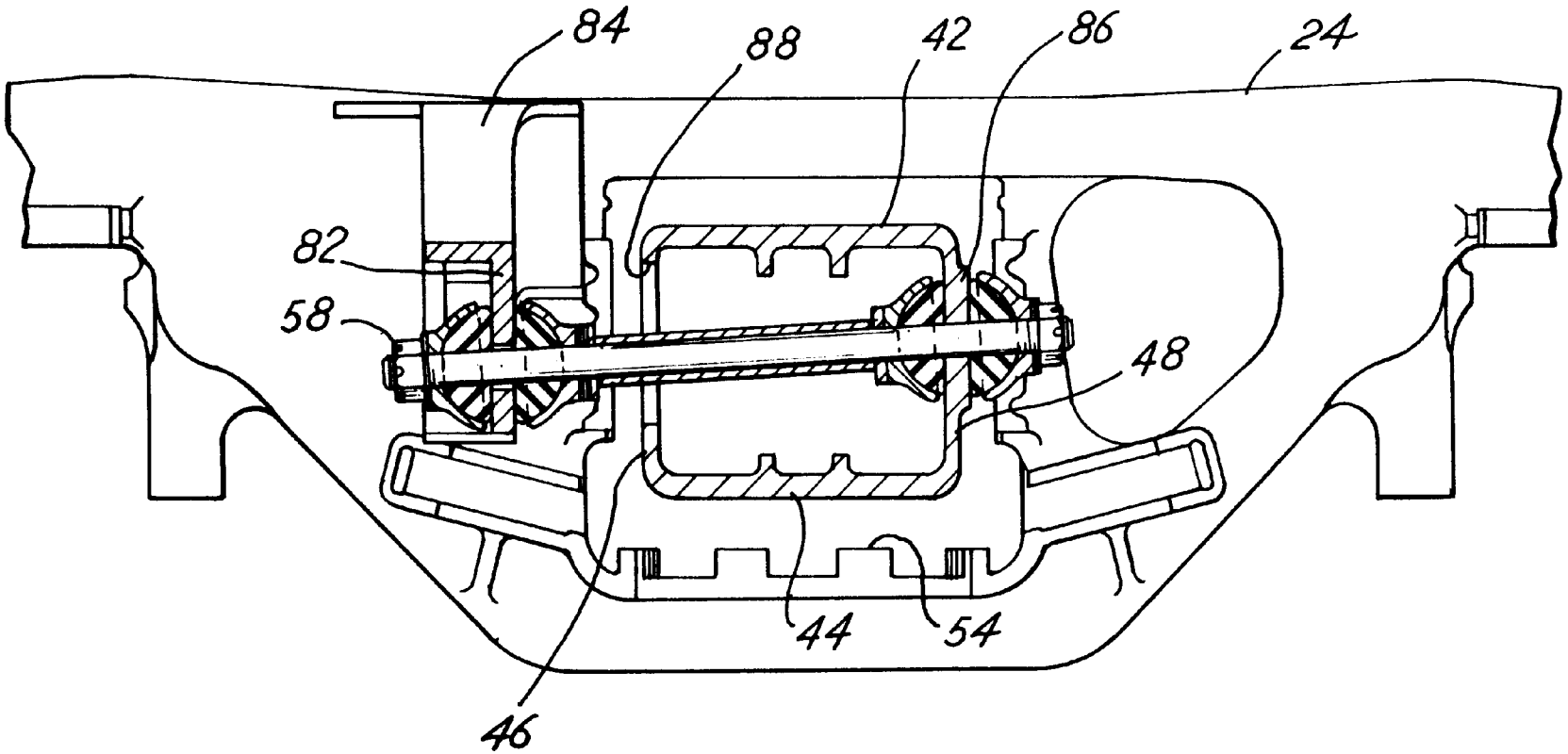
FIG. 4 is a second cross-section view of the truck, and more specifically a longitudinal cross-section through the bolster, taken along line 4—4 in FIG. 1.

Referring to FIGS. 1, 2 and 3, a transversely extending truck bolster 34 extends between and through the side frames 22, 24. The bolster includes a center bowl 36, aligned on the centerlines 11, 13 of the truck 10. Two opposed, elongated bolster arms 38, 40 extend transversely outward from beneath the center bowl 36. The arms 38, 40, and the bolster 34 overall, are formed of a top plate or member 42, also known as a compression member, a bottom plate or member 44, also known as a tension member, and two upright structural or side walls 46, 48. As shown in FIG. 4, the members 42, 44 and side walls 46, 48 form a rectangle, in cross-section of either arm 38, 40. The bolster arms 38, 40 extend outward a length such that in service, the bolster arms 38, 40 extend through bolster arm openings 50 in the side frames 22, 24. The bolster 34 is mounted on helical springs 51 which are also mounted in the bolster arm openings and supported on the side frames 22, 24. Spring seat bosses such as exemplary bosses 52 and 54, see FIGS. 2, 3 and 4, are formned in the bolster arms 38, 40 and side frames 22, 24 for mounting of the springs. Column guides 56 guide and control vertical motion of the bolster 34 relative to the side frames 22, 24 under action of the springs and the weight of the railcar and payload.

To provide alignment in addition to the alignment provided by the column guides 56 and axle bearings, both inner and outer bolster anchors 58, 60 interconnect the side frames 22, 24 and bolster 34. An inner bolster anchor 58 and an outer bolster anchor 60 interconnect each side frame and the bolster, as best seen in FIG. 1.

Figure 5:
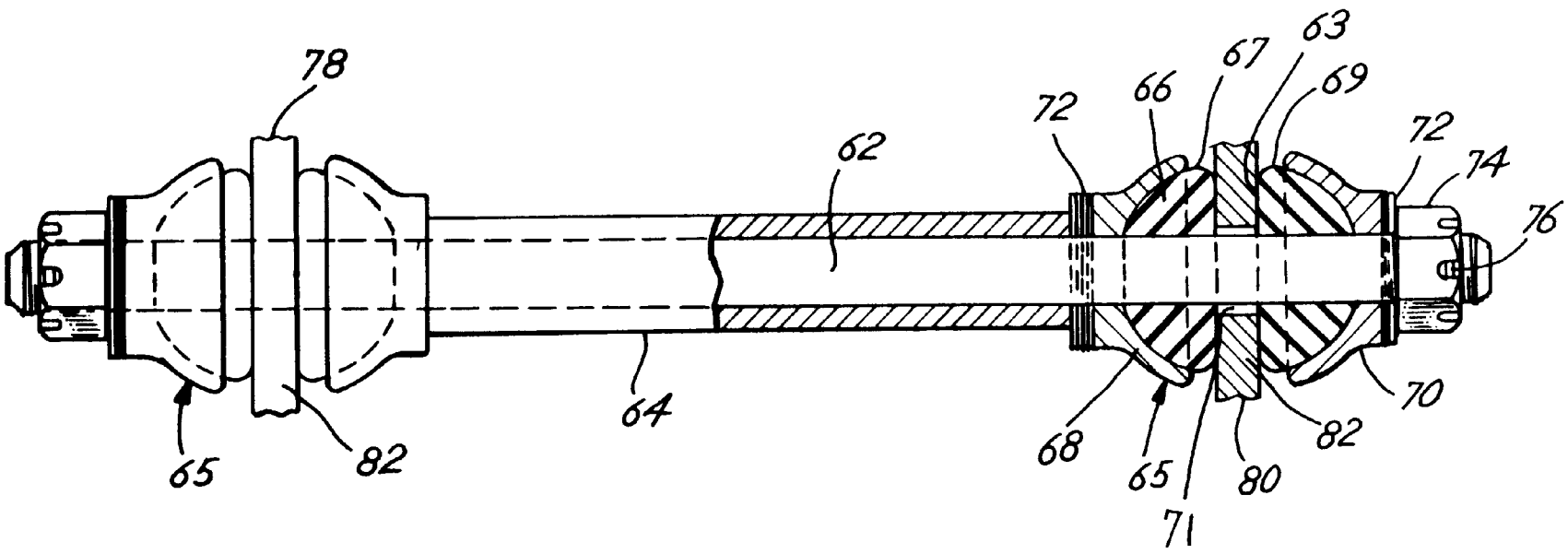
FIG. 5 is a detail view of a bolster anchor of the invention, with the right half of the anchor shown in section to reveal internal detail.

Referring to FIG. 5, each bolster anchor 58, 60 constitutes an assembly including an elongated central tie rod 62. As most preferred, the tie rod 62 is A.I.S.I. 4140 steel, heat treated according to A.S.T.M. specification A193-B7. The ends of the tie rod 62 are screw threaded. An elongated, annual spacer 64 is fitted on the central portion of the tie rod 62. Outward of the spacer, an anchor cushioning subassembly 65 is located on each end of the tie rod 62. In the subassembly 65, a rubber pad 66 is generally spherical, with an annular or ring-shaped gap 63 between hemispheres 67, 69. The pad 66 is slid on the tie rod through a close fitting tie rod channel 71.

An inner cup 68 and an outer cup 70 hold or cup the pad 66. The cups 68, 70 are also slid on the tie rod through tie rod channels (not marked). The opposed inner cups 68 abut the spacer 64, with the possible interposition of adjustment washers 72. The pads 66 abut the inner cups 68, the outer cups 70 abut the pads 66, and the subassembly and total assembly are held together by slotted nuts 74 and cotter pins 76, and further possible adjustment washers 72, threaded on the ends of the tie rod 62.

Referring to FIGS. 1 and 2, the outer bolster anchors 60 are mounted between the bolster 34 and side frames 22, 24 outboard or outward of the side frames. A first transversely outwardly extending outer bolster anchor bracket 78 is mounted to the outer end of each bolster arm 38, 40. A second transversely outwardly extending outer bolster anchor bracket 80 is mounted to the outer side of the side frame. The outer bolster anchors 60 are mounted to the brackets 78, 80. Referring to FIG. 5, plates 82 of the brackets 78, 80 extend into the gaps 63 of the rubber pads 66 of the anchors 60. That is, the anchors 60 are mounted to the brackets 78, 80 by fitting the rubber pads 66 to the bracket plates 82 such that the plates 82 fit the gaps 63, and a hemisphere 67, 69 of each pad 66 is on each side of the plate 82. The outer bolster anchors 60 are appropriately assembled between the brackets 78, 80.

Referring to FIGS. 1, 3 and 4, the inner bolster anchors 58 are also mounted between the bolster 34 and side frames 22, 24, inboard or inward of the side frames. A transversely inwardly extending inner bolster anchor bracket 84 is mounted to the inner side of each side frame 22, 24. In contrast with the outer anchors 60, the inner anchors 58 extend from the brackets 84 through the bolster 34 to the opposite side wall 48 of the bolster 34.

Referring to FIG. 3 and 4, the upper and lower limits of motion of the top member 42 and the bottom member 44 of the bolster 34, as the bolster 34 moves relative the side frames 22, 24, in service, define a zone of motion of the bolster 34. The side wall 48 of the bolster 34 includes bolster anchor fittings or seats 86 in the zone of motion of the bolster ("the bolster motion zone ") and more specifically, in the open area between the bolster top and bottom members 42, 44 ("the bolster cavity "). The sidewall 46 of the bolster 34 defines bolster anchor openings 88 opposite the bolster anchor fittings 86 in the side wall 48. The vertical extent of the openings 88 is sized for vertical pivoting of the inner anchors 58 relative to the fittings 86, in service. Transversely, both the fittings 86 and the openings 88 are located along the bolster arms 38, 40 inward of the bolster side bearing mounts 90 and outward of the bolster top member lightener openings 92, as seen in FIGS. 1 and 3.

Thus, the inner anchors 58 extend from the inner brackets 84 on the side frames 22,24 through the bolster anchor openings 88 in the near or proximate bolster side wall 46, through the bolster cavity between the bolster top and bottom members 42, 44, and in the bolster motion zone, to the bolster anchor fittings 86 on the distant or distal bolster side wall 86. Referring to FIG. 4, a plate 82 of the bracket 84 extend into the gap 63 of a rubber pad 66 of each anchor 60, and the fitting 86 extends into the gap 63 of the opposite rubber pad 66. As with the outer anchors 60, the inner anchors 58 are mounted to the bracket 84 and fitting 86 by fitting the rubber pads 66 to the bracket plate 82 and fitting 86 such that the plate 82 and fitting 86 fit the gaps 63, and a hemisphere 67, 69 of each pad 66 is on each side of the plate 82 and fitting 86. The inner bolster anchors 58 are appropriately assembled between the bracket 84 and fitting 86.

As provided and assembled, and especially with the inner anchors 58 provided and located as described, in the bolster motion zone, extending through the bolster anchor openings and through the bolster cavity, the anchors 58, 60 uniquely align the described freight railcar truck with a structure which is economical and provides high performance. The objects and advantages of the invention are achieved. As the described trucks traverse curved track, the bolsters provide an aligning and then restorative force to significantly better align and as necessary realign the trucks. During assembly, the adjustment washers 72 provide a means for accurately aligning the trucks despite tolerance variations. Also, the column guides may be adjusted in formation and during service to eliminate contact with bolsters, and eliminate column guide binding and wear. The rubber of the anchor pads is selected for a rate to effectively transmit acceleration and braking forces between the railcar bod and truck, while contributing little resistance to vertical and lateral movements of the bolster on the springs 51. Lateral movement is accommodated and may be limited by stops on the side frames. Bearing life, and overall component life, is extended.

The vertical locations of the anchor brackets and fitting are selected such that the anchors are essentially horizontally aligned when the trucks are in service and the associated railcar is typically loaded and located on level track. As seen in FIG. 4, the anchor fittings 86 are toward the top of the sidewall 86 for this purpose. Also as seen in FIG. 4, the truck has a railcar above it, which is empty, and the inner anchors are angled upward toward the fittings 86 because of lack of loading. As shown in FIG. 2, the outer anchor brackets 78, 80 are located in the same manner relative to each other such that horizontal positioning of the outer anchors 60 occurs during loading, and as shown, the outer anchors are angled upward toward the first bolster anchor brackets 78.

To the extent necessary because of the bolster anchor openings 88, the bolster internal ribbing is strengthened. Other than as described, the bolster with the invented truck is essentially conventional. The same is true of the side arms. No change is made of the connection between railcar bodies and trucks. No change is made to railcar bodies. All components may be cast essentially as in the past, with automatic molding equipment. Thus, variation form conventional freight railway trucks and railcars is minimized while the benefits of the invention are achieved. Conventional equipment is useful for casting the components of the truck, the truck is quite economical, and the bolster anchors greatly enhance the alignment and performance of the trucks. The trucks are significantly smoother riding, better curving, suitable for higher train speeds, and provide railcars suitable for more sensitive payloads.

Those skilled in the art recognize that the preferred embodiments may be altered and modified without departing from the true spirit and scope of the invention as defined in the appended claims. As an example, components such as the bolster may be cast as a unitary steel item, or assembled as a steel weldment or otherwise. Except as noted, generally all described components are steel or equivalent material. To particularly point out and distinctly claim the subjects regarded as invention, the following claims conclude this specification.

I claim:

1. A railway vehicle truck assembly comprising at least two longitudinally spaced, transversely extending axles, wheels mounted to the axles, transversely spaced longitudinally extending side frames mounted to the axles, a transversely extending truck bolster mounted to the side frames, the truck bolster having structural walls, a top plate and a bottom plate joining the structural walls, the structural walls and top and bottom plates defining an inner cavity, and at least one bolster anchor connecting at least one side frame to the truck bolster, the at least one bolster anchor located transversely between the side frames, and extending at least in part through the inner cavity of the truck bolster and mounted within the inner cavity to one of the structural walls.

2. A railway vehicle truck assembly as in claim 1 further comprising at least two bolster anchors connecting the side frames to the truck bolster, the at least two bolster anchors both located transversely between the side frames, and both extending at least in part through the inner cavity of the t bolster.

3. A railway vehicle truck assembly as in claim 2, the at least two bolster anchors comprising tie rods and fasteners for fastening the tie rods between the side frames and the bolster.

4. A railway vehicle truck assembly as in claim 3, the tie rods fastened between the side frames and opposite structural walls of the bolster.

5. A railway vehicle truck assembly as in claim 1, the at least one bolster anchor comprising a tie rod and fasteners for fastening the tie rod between the at least one side frame and the bolster.

6. A railway vehicle truck assembly as in claim 5, the tie rod fastened between the side frame and a structural wall of the bolster.

7. A railway vehicle truck bolster comprising a center bowl and opposed, elongated bolster arms extending from the center bowl, the bolster arms each forming spaced structural walls, a top plate and a bottom plate, the structural walls and plates defining an inner cavity, a first of the structural walls of each bolster arm having a bolster anchor fitting defined thereon, the bolster anchor fitting located on the first of the structural walls such that it receives a bolster anchor within the inner cavity, and a second of the structural walls of each bolster arm having a bolster anchor opening defined therethrough, the bolster anchor opening defined as a vertically elongated opening for unimpeded movement of the bolster anchor relative to the second structural wall through a range of positions relative to the second structural wall.

8. A railway vehicle truck bolster as in claim 7, the bolster anchor fitting including a pad for fastening of a bolster anchor thereto.

9. A railway vehicle truck assembly comprising at least two longitudinally spaced, transversely extending axles, wheels mounted to the axles, transversely spaced longitudinally extending side frames mounted to the axles, a transversely extending truck bolster mounted to the side frames, the truck bolster having a center bowl and opposed, elongated bolster arms extending from the center bowl, the bolster arms each forming spaced structural walls, a top plate and a bottom plate joining the structural walls, a first of the structural walls of at least one of the bolster arms having a bolster anchor fitting defined thereon, and a second of the structural walls of at least one of the bolster arms having a vertically elongated bolster anchor opening defined therethrough, the bolster anchor fitting including a pad for fastening of a bolster anchor thereto, the structural walls and the top plate and bottom plate defining an inner cavity, the bolster fitting located on the first of the structural walls and within the inner cavity, at least one bolster anchor connecting at least one side frame to the truck bolster, the at least one bolster anchor located transversely between the side frames, the at least one bolster anchor extending from the fitting and extending through the inner cavity of the truck bolster and through the bolster opening in the second of the structural walls to the at least one side frame.

10. A railway vehicle truck assembly as in claim 12, the bolster defining a bolster motion zone, the fitting located in the bolster motion zone.

* * * * *